United States Patent [19]

Yatcilla et al.

[11] 4,168,659

[45] Sep. 25, 1979

[54] BALE DENSITY CONTROL SYSTEM

[75] Inventors: George Yatcilla, Newton; Garold L. Fleming, Hesston; Kurt Graber, Moundridge; Loren L. Alderson, Nickerson, all of Kans.

[73] Assignee: Hesston Corporation, Hesston, Kans.

[21] Appl. No.: 882,132

[22] Filed: Feb. 28, 1978

[51] Int. Cl.[2] ..... B30B 15/26

[52] U.S. Cl. ..... 100/43

[58] Field of Search ..... 100/DIG. 8, 43, 191, 100/192

[56] References Cited

U.S. PATENT DOCUMENTS

| | | | |
|---|---|---|---|
| 2,576,784 | 11/1951 | Dodds | 100/43 |
| 2,582,672 | 1/1952 | Bobst | 100/43 |
| 2,708,872 | 5/1955 | Lauck | 100/43 |
| 2,718,189 | 9/1955 | Bornzin | 100/43 |
| 2,763,201 | 9/1956 | Hauswirth | 100/43 |
| 2,796,825 | 6/1957 | Kreigbaum | 100/43 |
| 2,890,646 | 6/1959 | Soteropulos | 100/43 |
| 2,982,201 | 5/1961 | Kruger | 100/191 X |
| 3,015,262 | 1/1962 | Baines | 100/43 |
| 3,121,387 | 2/1964 | Fuhrwerk | 100/43 |
| 3,866,529 | 2/1975 | Holman | 100/43 |

*Primary Examiner*—Billy J. Wilhite

*Attorney, Agent, or Firm*—Schmidt, Johnson, Hovey & Williams

[57] ABSTRACT

Hydraulic "squeeze cylinders" control the size of the discharge orifice on an extrusion baler and are operated by a control circuit that relieves pressure in the cylinders in response to the buildup of a certain predetermined pressure level in the circuit. Pressurized fluid for the squeeze cylinders is supplied by a single-acting pump cylinder that is connected between the reciprocal plunger head and its push rod in such a way as to deliver a slug of pressurized fluid into the circuit on each compression stroke of the plunger, the pump drawing in a fresh slug from a reservoir during each retraction stroke of the plunger. A pilot-operated relief valve is operated by circuit fluid when the latter reaches the predetermined pressure level to open a relief path for fluid in the squeeze cylinders, and specially calibrated ports in the circuit between the pump and the cylinders cause the relief valve-operating portion of the circuit on the pump side of the calibrated ports to exist at a higher pressure level than the remaining portion on the squeeze cylinder side.

14 Claims, 6 Drawing Figures

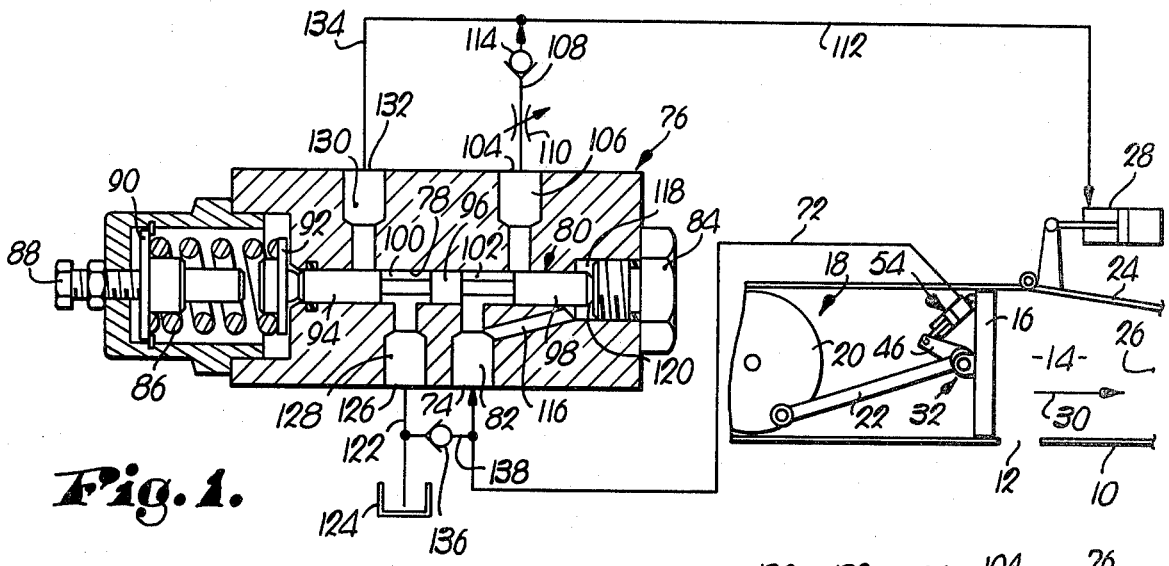
Fig. 1.
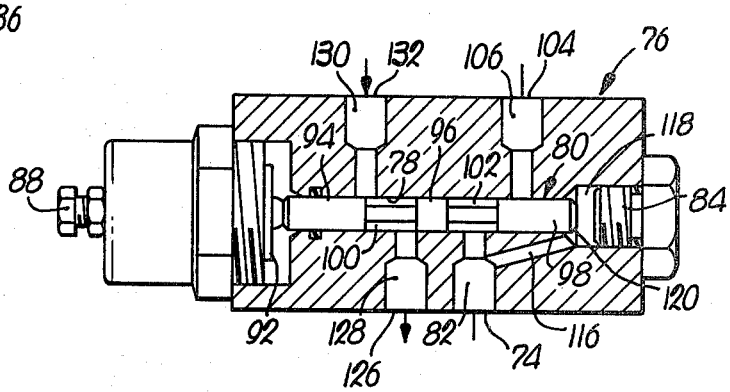
Fig. 2.
Fig. 3.
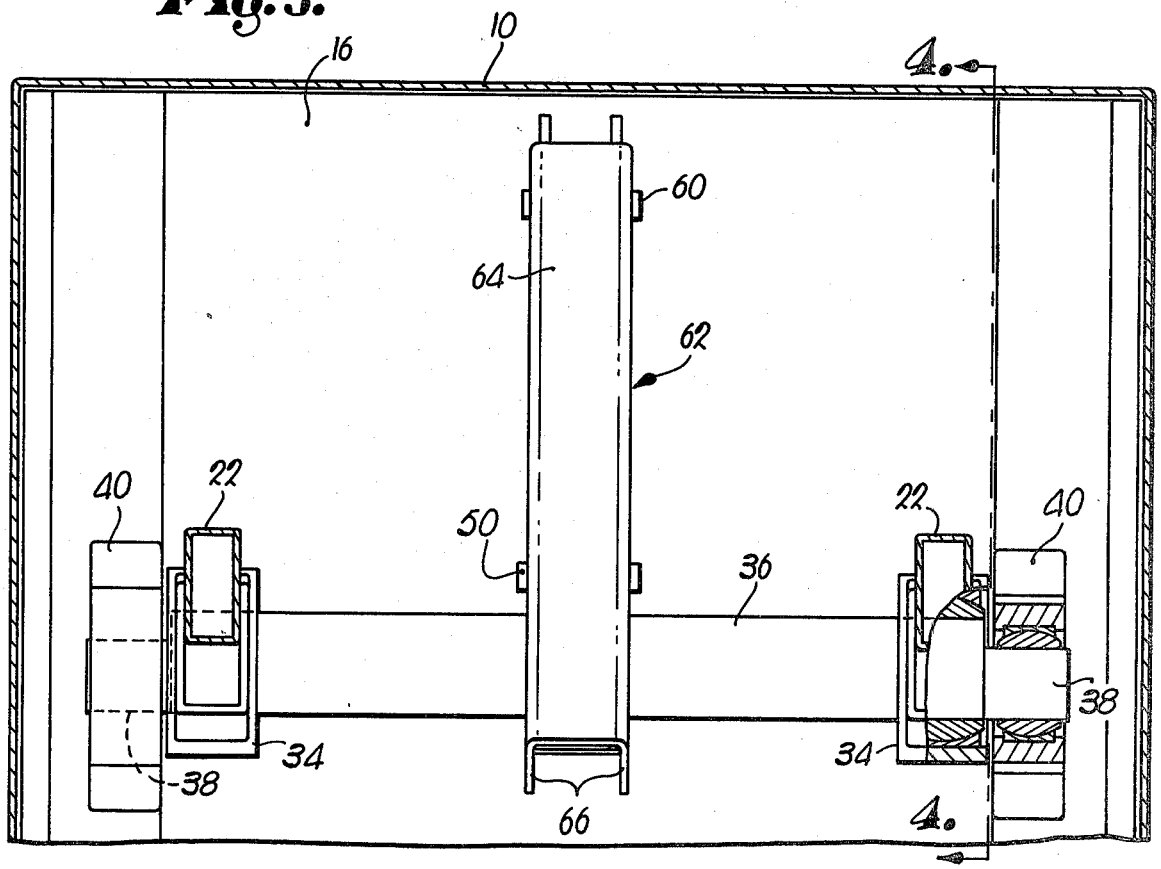

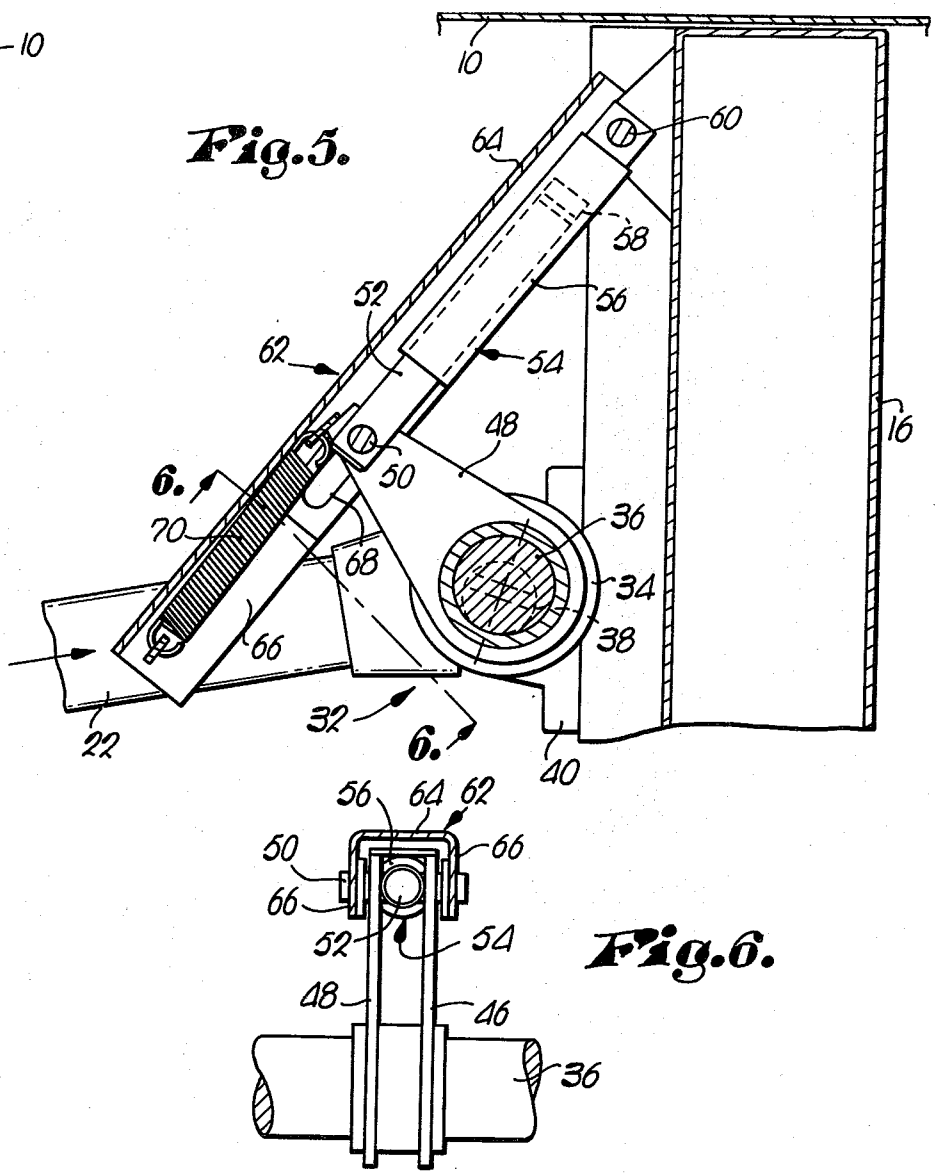
Fig. 5.
Fig. 6.
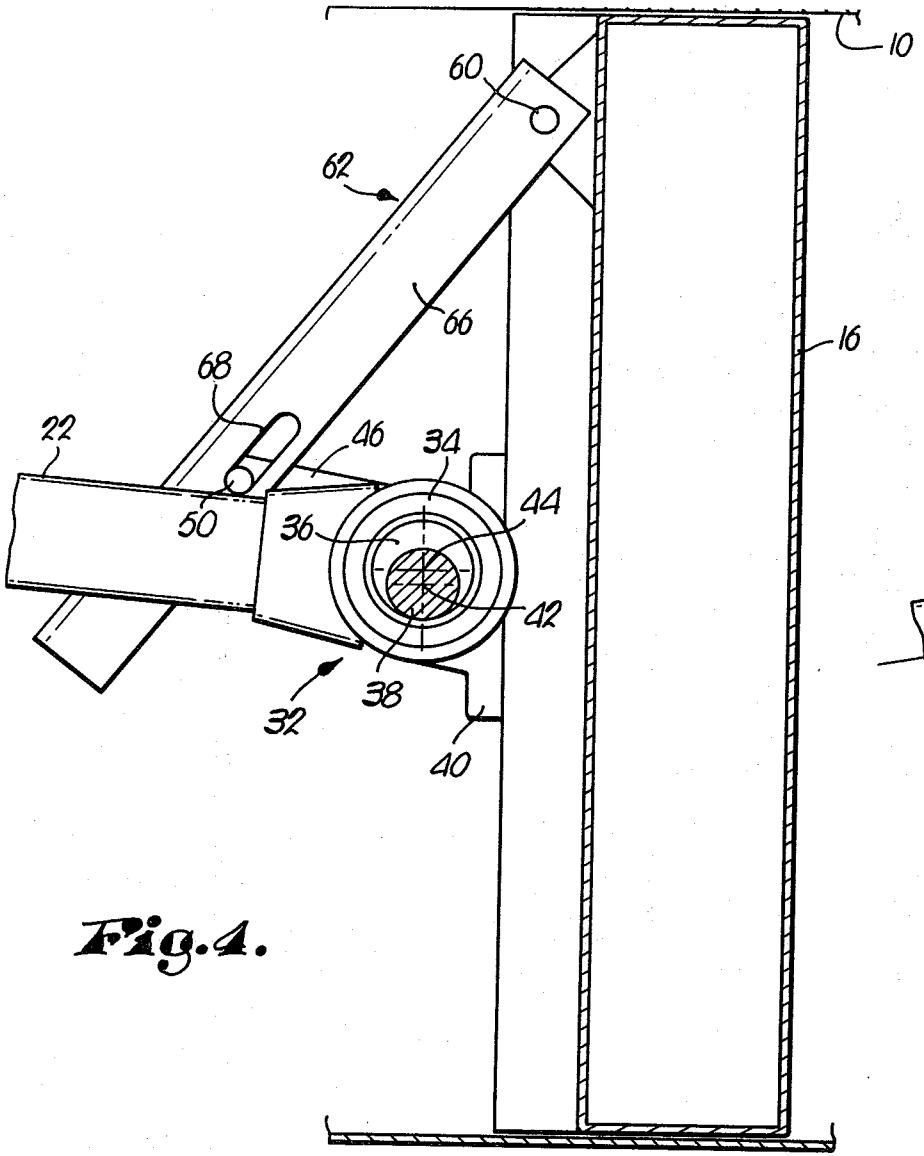
Fig. 4.

BALE DENSITY CONTROL SYSTEM

This invention relates to controlling the density of bales produced in an extrusion-type baler wherein successive charges of material are introduced into a baling chamber and are forced through a restricted orifice by a reciprocating plunger. Typical prior control systems for this class of baler have relied upon mechanical sensors which activate a hydraulic control circuit for cylinders that control the size of the orifice, such sensors normally activating the circuits to either relieve or add fluid pressure depending upon the extent to which the sensors can penetrate the forming bale. In other words, the "tightness" or density of the forming bale results in the sensor being physically positioned in such a way that it performs an appropriate valving function so as to either further pressurize or depressurize the squeeze cylinders.

However, systems of this type rely upon very localized "readings" of bale density and thus may not accurately reflect the overall or average density of the bale being formed. Hence, the degree of uniformity of density throughout the bale may suffer.

Rather than sense bale density on a local, concentrated basis in the foregoing manner, the present invention contemplates sensing pressure buildup in the hydraulic circuit that controls the squeeze cylinders and taking such corrective steps as may be necessary in response to that buildup, such being possible as a way to provide the necessary control function inasmuch as the pressure buildup in the circuit is directly related to the resistance encountered by the bale as it attempts to move through the orifice under the impetus of the plunger. Thus, by basing the control system on resistance to bale movement rather than depth of penetration at any localized spot in the bale, the condition of the bale as a whole is more fully considered, to the end that adjustments which more accurately reflect the state of things can be automatically effected.

While the concept of utilizing the perception of hydraulic pressure to trigger a certain control function in a baler is not per se new, prior systems attempting to incorporate such an approach have suffered from the disadvantage of being unduly complex and unreliable. Accordingly, one important object of the present invention is to obtain the benefits inherent in a bale density control system that operates on the principle of being responsive to fluid-pressure levels in the system but without the disadvantages of untoward complexity, etc., of prior systems incorporating such principles.

Another important object of the present invention is to provide a fluid-pressure-triggered system as aforesaid, which is based on the principle that more nearly uniform bale density can be achieved if the system is geared toward keeping the plunger operating at a certain constant compactive force regardless of variations in crop conditions such as, for example, moisture content and the coefficient of friction between the crop and walls of the baling chamber. Inasmuch as variables of this type can and do affect the pressure level at the squeeze cylinders that is required in order to arrive at a certain constant force loading on the plunger, it is important to have a system that will accommodate such pressure fluctuations at the squeeze cylinders without causing a responsive adjustment in the system that would increase or decrease the compactive force of the plunger.

Stated differently, it is recognized that certain crop conditions may require one pressure level at the squeeze cylinders to achieve a certain amount of compactive force by the plunger while a second crop condition may require a different pressure level at the squeeze cylinders to achieve the same compactive force at the plunger. For example, straw may be easier to push through the bale chamber than hay because of straw's "slickness" and may thus require greater pressure at the squeeze cylinders in order to achieve the same compactive force from the plunger as with hay. Accordingly, if the system is to be based upon the proposition that more uniformity of bale density can be ultimately achieved if the system is geared to maintaining a certain constant compactive force of the plunger, then it is desirable to have a system that will achieve such end notwithstanding the fact that it may take different squeeze pressures at different times to produce that certain compactive force from the plunger.

Hence, it is an important object of this invention to provide a fluid-pressure-triggered system which is capable of operating at a relatively constant compactive plunger force while tolerating wide fluctuations in pressure levels at the squeeze cylinders.

An additional important object of this invention is to mechanically link the plunger with the hydraulic pump of the system in such a way that the resistance encountered by the plunger during its compaction stroke is transmitted to the pump so as to displace the latter through a pumping stroke, thus adding a slug of pressurized fluid to the hydraulic circuit that can be routed to the squeeze cylinders if additional pressure is required at that location to bring the compactive force of the plunger up to its desired level.

Additionally, an important object of this invention is to provide an arrangement wherein increases or reductions in the pressure level of the squeeze cylinders are made in relatively small increments so as to avoid the possibility of sudden drastic pressure drops or increases that would adversely affect bale density.

Yet another important object of this invention is to provide a way in which the compactive force for the plunger can be selected or adjusted as may be necessary and desirable.

In the drawings:

FIG. 1 is a largely schematic view of a density control system according to the principles of the present invention;

FIG. 2 is an isolated view of a special valve forming a part of such system and showing the same actuated so as to relieve pressure in the squeeze cylinders;

FIG. 3 is an enlarged, transverse vertical cross-sectional view through the bale case and illustrating the manner in which the plunger is connected with its drive apparatus;

FIG. 4 is a vertical cross-sectional view thereof taken along line 4—4 of FIG. 3;

FIG. 5 is a view similar to FIG. 4, but with additional parts shown in cross section and illustrating the pump moved through a pump stroke; and FIG. 6 is a fragmentary cross-sectional view taken substantially along line 6—6 of FIG. 5.

PRIOR PATENTS OF POSSIBLE RELEVANCE

| | |
|---|---|
| Seltzer | 3,467,000 |
| Hauswirth | 2,763,201 |
| Baines | 3,015,262 |

-continued

| PRIOR PATENTS OF POSSIBLE RELEVANCE | |
|---|---|
| Dodds, et al | 2,576,784 |
| Soteropulos | 2,890,646 |
| Bornzin | 2,718,189 |
| Bornzin | Re. 24,155 |
| Holman | 3,866,529 |
| Kruger, et al | 2,982,201 |
| Bobst | 2,582,672 |
| Lauck | 2,708,872 |
| Lauck | 2,758,536 |

As illustrated in FIG. 1, the bale case 10 has a lateral opening 12 through which material to be baled is introduced into the baling chamber 14. A plunger 16 is reciprocated within the chamber 14 by apparatus 18 that may take the form of a rotating drive wheel 20 and a pitman rod 22 disposed in cranked relationship to the axis of rotation of the wheel 20. Laterally shiftable structure which may take the form of a wall 24 of the bale case 10 cooperates with the remainder of the latter to define a discharge orifice 26 whose dimensions may be restricted relative to the remainder of the bale case 10 through one or more devices in the nature of a hydraulically powered "squeeze" cylinder 28 coupled mechanically with the shiftable wall 24. Thus, the reciprocating plunger 16 packs material through the bale case 10 in the direction of the arrow 30 and against the resistance afforded by the constricted nature of the orifice 26. The process is therefore akin to an extrusion operation.

Referring now more specifically to FIGS. 3–6, the pitman rod 22 has a special lost-motion connection 32 with the plunger 16. In the preferred form, a pair of such rods 22 are utilized as illustrated in FIG. 3, and each of the rods 22 carries a bearing 34 that concentrically and rotatably receives the corresponding end of a rockshaft 36 extending across the back of the plunger 16. A pair of pintles 38 project outwardly from opposite ends of rockshaft 36 in eccentric relationship to the longitudinal axis thereof and are journaled by pillow block bearings 40 rigidly affixed to the back of the plunger 16. As illustrated in FIGS. 4 and 5, the axis 42 of the pintles 38 thereby serves as the axis of rotation of the rockshaft 36 relative to the plunger 16, even though such axis 42 is eccentrically disposed with respect to the longitudinal axis 44 of rockshaft 36.

A pair of cranks 46 and 48 are rigidly affixed to the rockshaft 36 in slightly spaced-apart relationship along the latter. At their outer ends the cranks 46, 48 carry a cross pin 50 that bridges the cranks 46, 48 and is in turn pivotally connected to the rod 52 of a single-acting, rectilinear pump 54. Pump 54 further includes a cylinder 56 slidably receiving the ram 58 of rod 52 and connected at its upper end by pivot 60 to the plunger 16. Thus, cranks 46 and 48 reciprocate the ram 58 as the shaft 36 rocks.

The pump 54 is housed within an inverted, U-shaped channel 62 that is pivotally mounted on the plunger 16 via the pivot 60 of pump 54. The channel 62 includes a bight portion 64 overlying the pump 54 and a pair of depending legs 66 having aligned longitudinally extending slots 68 that receive the opposite ends of the cross pin 50. The stroke of pump 54 is thereby limited by the opposite terminal ends of the slots 68, and a return spring 70 is connected between the lower end of the channel 64 and the outer end of the crank 48 for the purpose of assuring that the rod 52 is withdrawn fully during a return stroke of the plunger 16.

As illustrated in FIGS. 1 and 2, the cylinder 56 on the side of ram 58 opposite the rod 52 is connected with a hydraulic control circuit via a line 72 leading to a high pressure port 74 in a valve body 76. Port 74 communicates with a bore 78 in the body 76 that slidably receives a spool 80, such communication being by way of a passage 82. The spool 80 is yieldably biased in a rightward direction viewing FIG. 1 against a plug 84 by a compression spring 86 at the end of spool 80 opposite the plug 84. The extent of bias from the spring 86 may be adjusted by appropriately rotating adjusting screw 88 which bears against a plate 90 that in turn engages the proximal end of the spring 86 to compress the latter against an opposite plate 92 having engagement with the spool 80.

The spool 80 is provided with three lands 94, 96 and 98 separated by a pair of annular regions 100 and 102 on opposite sides of the land 96. When the spool 80 is in the position of FIG. 1 against the plug 84, the inlet port 74 is in communication with an outlet port 104 via a passage 106 leading from the region 102 that is in turn connected with the passage 82. A high pressure line 108 leads from the port 104 through a restricted port or orifice 110 and connects with a line 112 leading to the rod side of the squeeze cylinder 28, there being a check valve 114 in line 108 to permit flow in the latter only in a direction toward squeeze cylinder 28.

A pilot passage 116 extending diagonally through the valve body 76 from the passage 82 communicates the inlet port 74 with a pilot chamber 118 at the rightmost end of the bore 78. The right end of the spool 80 has a circumferential bevel 120 exposed to the fluid pressure within pilot chamber 118.

A dump line 122 of the circuit leading to reservoir 124 is connected to an outlet port 126 that communicates with region 100 via a passage 128. Central land 96 blocks communication between the passages 82 and 128 at all times, which land 94 controls communication between passage 128 and another passage 130 leading from port 132, the latter in turn being connected to the line 112 via a line 134. In a similar way, land 98 at the right end of the spool 80 controls communication of the passages 82 and 106 with one another. A check valve 136 in a short line 138 between lines 72 and 122 permits fluid flow between such lines only in the direction toward the pump 54 during negative displacement of the latter on a retraction or suction stroke.

OPERATION

The spool 80 is normally in its rightmost position of FIG. 1. This opens the rod side of the squeeze cylinder 28 to fluid from the pump 54 along an operating pressure path defined by line 72, port 74, passage 82, region 102, passage 106, port 104, line 108 and line 112. Thus, as the plunger 16 is shifted through a compaction stroke toward the right end of the bale case 10 viewing FIG. 1, a slug of oil is forced from the pump 54 along such operating path. The motion for the positive displacement of the ram 58 of the pump 54 is, of course, derived from the nature of the lost-motion connection 32 between the pitman rod 22 and the plunger 16. Thus, the rockshaft 36 is rocked about the axis 42 in a clockwise direction viewing FIGS. 4 and 5 to correspondingly swing cranks 46, 48 and displace the pump rod 52 to the extent permitted by the right end of the slots 68 as viewed in FIGS. 4 and 5. During such a pumping stroke on the part of the pump 54, the oil along the operating path has no choice but to flow to the squeeze cylinder 28, inasmuch as all routes to the reservoir 124 are blocked so long as the spool 80 remains in FIG. 1 position. Note in this regard that the check valve 136 closes line 138 to the reservoir 124; land 96 closes off communication between passage 82 and passage 128; and, although line 134 may be pressurized, the fluid therein is prevented from dumping to the reservoir 124 by virtue of the blockage by land 94 of the passage 130.

On each retraction stroke of the plunger 16 in a leftward direction viewing FIG. 1, the pump 54 is drawn through a suction stroke by either the cranks 46, 48 operating alone or in conjunction with the return spring 70. In either event, the effect of this stroke is to unseat the check valve 136 so as to allow an increment of fluid to be drawn from the reservoir 124 through the line 138 and into the operating path of the circuit. Note that the check valve 114 in line 108 prevents the pump 54 from drawing any fluid out of the squeeze cylinder 28 at this time.

As a result of this pumping action on the part of the pump 54, the operating path is progressively pressurized to a greater and greater degree, thereby increasing the "squeeze" of the shiftable wall 24 on the bale that is being advanced through the chamber 14 by the reciprocating plunger 16. That, in turn, increases the resistance of the bale to advancement by the plunger 16, hence increasing the compactive force of the latter on the fresh charges of material entering through the inlet 12. The compactive force applied by the plunger 16 is likewise transmitted to the circuit through the pump 54 via its mechanical connection with the plunger 16.

Fluid pressure in the operating path is also transmitted to the pilot chamber 118 and hence to the bevel 120 on spool 80 via the pilot line 116. Once that pressure reaches a level sufficient to overcome the resistance of the spring 86, the spool 80 will be shifted leftwardly such as to the opposite extreme position illustrated in FIG. 2. This has the immediate effect of opening a pressure relief path from the squeeze cylinder 28 via the line 112, line 134, port 132, passage 130, region 100, passage 128, port 126 and line 122 into the reservoir 124. At the same time, the land 98 moves into blocking relationship to the passage 106 so that further pressurized fluid from the pump 54 will not be admitted to the squeeze cylinder 28. This, then, has the effect of relieving the squeeze on the bale emerging through the orifice 26 so as to in turn reduce the bale's resistance to movement by the plunger 16, thereby keeping the compactive force of the latter from exceeding a selected level that corresponds with the setting of the adjusting screw 88 against the compression spring 86.

Parenthetically, it should be noted that once land 98 blocks passage 106, pump 54 can no longer make a pumping stroke (or complete one that may have been started). Suitable relief valving (not shown) may be provided in line 72 set at a higher relief pressure than the pilot pressure necessary to shift spool 80 so as to avoid any excessive pressures in the circuit when this condition obtains.

Relief of the squeeze cylinder 28 will occur on the compression stroke of the plunger 16 at a time when the pump 54 attempts to add additional fluid into the operating path. Thus, as long as sufficient pressure from the pump 54 is present during a compaction stroke to maintain the spool 80 shifted leftwardly as in FIG. 2, the squeeze cylinder 28 will be relieved. Immediately upon beginning the retraction stroke of the plunger 16, the pressure in pilot chamber 118 will, of course, decrease so that the spring 86 will return the spool 80 to its original condition such that the squeeze cylinder 28 is no longer relieved. Moreover, relieving the squeeze cylinder 28 has the effect also of relieving the pressure in the pilot chamber 118 in view of the fact that the resistance to bale movement by the plunger 16 may be diminished slightly so as to accordingly reduce the pressure applied by the ram 58 of the pump 54.

Of importance is the fact that, in the preferred form, the squeeze cylinder 28 is normally operating at a lower pressure than that existing in the pilot chamber 118. This pressure differential is desirable due to the fact that the pressure required at the squeeze cylinder 28 to achieve a certain compressive force by the plunger 16 may fluctuate widely depending upon such things as moisture content and the nature of the materials being baled. For example, certain crops may exhibit a relatively high coefficient of friction with respect to their movement along the walls of the bale case 10. Thus, lower squeeze pressures would be required at the cylinder 28 in order to result in a certain compressive force by the plunger 16 than would be true with materials which would more easily slide through the bale case 10. In those latter instances, it would be necessary to squeeze the material more tightly in order to achieve the same resistance to movement and, thus, the same compressive or compactive force by the plunger 16.

To accommodate these fluctuations in applied pressure at the squeeze cylinder 28, then, it is preferred that the above-mentioned pressure differential be introduced between the squeeze cylinder 28 and the pilot chamber 118. This can be accomplished at least in part by careful calibration of the various ports along the operating path of the circuit (which includes the port 74, passage 82, region 102, passage 106 and port 104 in the valve body 76). The relationship between the leftmost end of land 116 and the passage 106 can be critical in this regard. Additionally, an orifice 110, preferably of the adjustable type, can be provided in the line 108 leading from port 104 so as to facilitate achievement of the desired differential.

For purposes of illustration only, it might be assumed, for example, that it is desired to cause leftward actuation of the spool 80 when the pressure in pilot chamber 118 reaches 3,000 P.S.I. This would correspond to a certain predetermined compressive force on the part of the plunger 16 and a corresponding loading on the pitman rods 22. In a typical situation under "normal" crop conditions, the pressure in squeeze cylinder 28 may be 1,500 P.S.I. Thus, in this situation, even if "abnormal" crop conditions are encountered throughout a day's operation (such as might be true comparing crop moisture conditions in the morning and afternoon), the pressure at squeeze cylinder 28 may fluctuate as may be required to achieve 3,000 P.S.I. in the pilot chamber 118. The result of this is that the user need select only a setting of the adjusting screw 88 that will result in a certain compactive force loading of the plunger 16. That loading will be automatically maintained throughout the day regardless of variations in crop conditions. Thus, the process is more fully automated than prior systems and greater uniformity of bale density is acheived.

Having thus described the invention, what is claimed as new and desired to be secured by Letters Patent is:

1. In a baler of the type wherein a reciprocable plunger incrementally compacts and forces a bale through a restricted orifice as new material is periodically added between the plunger and the orifice, said orifice being at least partially defined by structure that is shiftable laterally with respect to the path of bale travel through the baler for the purpose of enlarging or restricting said orifice, said structure having a fluid-pressure device coupled therewith for applying a holding force against movement of the structure in a direction to enlarge the orifice, the improvement comprising:

a fluid-pressure circuit connected with said device for pressurizing the same to effect said holding force, said circuit being responsive to pressure therein beyond a certain predetermined level to depressurize the device by an amount which reduces said holding force; and power apparatus separate from said circuit for reciprocating said plunger, said circuit including an intermittent pump operable through a pumping stroke to supply a slug of fluid to said device only during a compression stroke of the plunger.

2. In a baler as claimed in claim 1, wherein said circuit includes means between said pump and the device for producing a pressure drop on the device side of said means as compared to the pump side thereof, said predetermined pressure level to which the circuit is responsive being on said pump side of the circuit.

3. In a baler as claimed in claim 1, wherein said pump is provided with means for at least assisting in moving the same through a return stroke following the compression stroke of the plunger, said pump being connected with a source of fluid supply during said return stroke for drawing fluid into the pump.

4. In a baler as claimed in claim 3, wherein said means for at least assisting in moving the pump through its return stroke includes a spring.

5. In a baler as claimed in claim 1, wherein said power apparatus for the plunger includes a push-pull rod, said rod and said plunger having a lost-motion connection therebetween by which the rod can move relative to the plunger during a compression stroke of the latter, said pump being responsive to said relative lost-motion movement to effect its pumping stroke.

6. In a baler as claimed in claim 5, wherein said pump includes a piston and cylinder assembly, one end of said assembly being coupled with the plunger and the opposite end thereof being coupled with said rod.

7. In a baler as claimed in claim 5, wherein said lost-motion connection includes a rockshaft mounted on the plunger for oscillation about an axis, said rod being pivotally connected to said rockshaft eccentrically of said axis for effecting said oscillation of the rockshaft.

8. In a baler as claimed in claim 7, wherein said rockshaft has a longitudinal axis and a pair of pintles projecting from opposite ends thereof, said pintles being eccentric to said longitudinal axis and defining said axis of oscillation of the rockshaft, said rod being pivotal about said longitudinal axis of the rockshaft.

9. In a baler as claimed in claim 8, wherein said rockshaft is provided with a crank, said pump including a piston and cylinder assembly connected at one end to the plunger and at the opposite end to said crank.

10. In a baler as claimed in claim 5, wherein said lost-motion connection permits opposite relative movement between the rod and the plunger during a retraction stroke of the plunger so as to shift said pump through a return stroke, said pump being connected with a source of fluid supply during said return stroke for drawing fluid into the pump.

11. In a baler as claimed in claim 10, wherein said circuit further includes a check valve precluding retrograde fluid flow from device during said return stroke of the pump.

12. In a baler as claimed in claim 1, wherein said circuit includes a pressure relief path for fluid from said device and a valve normally closing said relief path, said valve being responsive to said certain predetermined pressure level to open said relief path.

13. In a baler as claimed in claim 12, wherein said circuit includes an operating pressure path for introducing fluid into said device, said valve opening said operating path when closing said relief path, and closing the operating path when opening the relief path.

14. In a baler as claimed in claim 13, wherein said pump is connected to said device via said operating path, said circuit further including means along said operating path between said pump and said device for producing a pressure drop in said operating path on the device side of said means, said valve being connected with the pump side of said path.

* * * * *